US006939414B2

(12) United States Patent
Menk

(10) Patent No.: US 6,939,414 B2
(45) Date of Patent: Sep. 6, 2005

(54) NODULAR GRAPHITE IRON ALLOY

(75) Inventor: Werner Menk, Schaffhausen (CH)

(73) Assignee: Georg Fischer Fahrzeugtechnik AG, Schaffhausen (CH)

( * ) Notice: Subject to any disclaimer, the term of this patent is extended or adjusted under 35 U.S.C. 154(b) by 22 days.

(21) Appl. No.: 10/469,650

(22) PCT Filed: Dec. 7, 2002

(86) PCT No.: PCT/EP02/13895

§ 371 (c)(1),
(2), (4) Date: Sep. 2, 2003

(87) PCT Pub. No.: WO03/057937

PCT Pub. Date: Jul. 17, 2003

(65) Prior Publication Data

US 2004/0091382 A1 May 13, 2004

(30) Foreign Application Priority Data

Jan. 14, 2002 (DE) ..... 102 01 218

(51) Int. Cl.[7] ..... C22C 37/04

(52) U.S. Cl. ..... 148/321; 420/9; 420/13; 420/26; 420/27

(58) Field of Search ..... 148/321; 420/9, 420/13, 26, 27, 99

(56) References Cited

U.S. PATENT DOCUMENTS 4,435,226 A * 3/1984 Neuhauser et al. ..... 148/545

FOREIGN PATENT DOCUMENTS

| | | |
|---|---|---|
| GB | 1 448 771 | 9/1976 |
| GB | 1 500 766 | 2/1978 |
| JP | 01108343 | 4/1989 |
| JP | 10195587 | 7/1998 |
| SU | 1285045 | 1/1987 |
| SU | 1752819 | 8/1992 |

* cited by examiner

*Primary Examiner*—Deborah Yee
(74) *Attorney, Agent, or Firm*—Bachman & LaPointe, P.C.

(57) ABSTRACT

A nodular cast iron alloy for cast iron products having a high modulus of elasticity comprising the chemical constituents C, Si, Cu, Ni and/or Mo, Mn, Mg and S, wherein the alloy is composed in per cent by weight of: C<2.96%, Si 3.8 to 4.3%, Cu 0.5 to 1.0%, Ni and/or Mo 0 to 4%, the molybdenum content being at most 1.0%, Mn 0.1 to 0.8%, Mg 0.03 to 0.07% and S at most 0.015%, the mixture proportions of C and Si being very close to the eutectic.

6 Claims, No Drawings

NODULAR GRAPHITE IRON ALLOY

BACKGROUND OF THE INVENTION

The invention relates to a nodular cast iron alloy for cast iron products having a high modulus of elasticity, the nodular cast iron alloy containing, as nonferrous constituents, at least the elements C, Si, Mn, Cu, Mg, S and, as admixtures, Ni and/or Mo.

Nodular cast iron alloys are used in the automotive industry for the production of castings which have to have a high resistance to torsional moments, for example the crankshaft, as part of the engine in the motor vehicle. The castings often have a very complex geometry with numerous areas which are subject to different levels of load and therefore have different wall thicknesses. This requires a casting technique which is suitable for parts with greatly differentiated geometries. Also, the castings often have to be aftertreated. The after treatment may be a heat treatment and/or a machining treatment. An important property which is desired for castings of this type is a modulus of elasticity which is as high as possible. Alloys with a modulus of elasticity of up to approximately 160 GPa are currently customary. A steel alloy will usually be used for parts with a modulus of elasticity which is as high as possible, and the parts will then be worked by forging. However, this is an expensive production method.

WO 99/19525 has disclosed a nodular cast iron alloy which can be used for shafts and disks of a disk brake. In per cent by weight, the alloy contains 1.5 to 4.5% of C, 1.5 to 4.5% of Si and at least 1.0 to 6.5% of Mo, as well as if appropriate Ni and Cu, the sum (% of Mo+% of Ni+% of Cu) not exceeding 6.5%, remainder iron and standard impurities. The alloy is distinguished by a good resistance to high temperatures and abrasion.

WO 96/38596 has disclosed a nodular cast iron alloy with a high modulus of elasticity.

The alloy contains, in per cent by weight: 3.0 to 3.8% of C, 2.0 to 2.6% of Si, 0.2 to 0.6% of manganese, less than 0.02% of P, less than 0.03% of S, 0.03 to 0.06% of magnesium, 0.8 to 1.2% of Ni, 0.8 to 1.2% of Cu, 0.4 to 1.0% of Mo, remainder Fe.

Nodular cast iron alloys with high pearlite and graphite contents are known. In these known alloys, the modulus of elasticity is too low for certain applications. If the graphite content is kept at a low level, the matrix content increases, as does the modulus of elasticity. More solid solution than graphite is formed.

Working on the basis of this prior art, it is an object of the invention to provide a nodular cast iron alloy for cast iron products with a modulus of elasticity of higher than 170 GPa.

SUMMARY OF THE INVENTION

The foregoing object is achieved by the present invention wherein an alloy comprises in per cent by weight: C<2.9%, Si 3.8 to 4.3%, Cu 0.5 to 1.0%, Ni and Mo up to 4%, Mn 0.1 to 0.8%, Mg 0.03 to 0.07% and S at most 0.015%, the mixture contents of C and Si being very close to the eutectic.

It is advantageous for the pearlite content in the microstructure of the cast iron products to be reduced and for the alloy to be very close to the eutectic. This is achieved by the pearlite content is 50 to 70%. The lower pearlite content improves the machining properties.

It is also advantageous for it to be possible to ensure consolidation of the solid solutions in the microstructure of the cast iron products. This is achieved by the Si content being 3.8 to 4.0%.

The basic idea of the invention is to provide a nodular cast iron alloy which is particularly suitable for crankshafts in internal combustion engines. The higher modulus of elasticity considerably reduces the risk of fracture, even in the case of a single-part shaft with a geometry with in alternation, relatively small and large cross sections, and considerably lengthens the service life of the shaft. The rigidity of the crankshaft is also increased. This leads to smoother running of the crankshaft. Smoother running also means that the vibrations which act on the bearings of the crankshaft are considerably reduced. As a result, the bearings and the shaft achieve a significantly longer operating life. The C content is crucial for the modulus of elasticity of the crankshaft. If the graphite content in the alloy is kept at a low level, the volumetric proportion of the solid solutions increases compared to the graphite content in the microstructure. This causes the modulus of elasticity to rise. Nodular cast iron alloys with C contents of below 3.0% have not previously been disclosed. Nodular cast iron alloys usually contain 10 to 15% by volume of graphite. The nodular cast iron alloy proposed here for the first time seeks to achieve a graphite content of at most 10% by volume.

EXAMPLE 1

A crankshaft for a motor vehicle engine of a passenger automobile made from nodular cast iron (GJS) having the following chemical composition: 2.8% C, 4.0% Si, 0.2% Mn, 0.9% Cu, 0.047% Mg, 0.005% S.

The microstructure consists of 60–70% of pearlite, 30 to 40% of ferrite. The total graphite content is 10%. The formation of graphite is greater than 90% V and VI (in accordance with DIN EN ISO 945) with a size of 6 to 7.

The mechanical properties of this casting are given as $Rp_{0.2}$=574 N/mm$^2$, $R_m$=811 N/mm$^2$ and A=2.7%. The modulus of elasticity is 179.5 GPa. The hardness over the entire cross section is: 254–285 HB10/3000.

What is claimed is:

1. A nodular cast iron alloy for cast iron products having a high modulus of elasticity comprising the chemical constituents C, Si, Cu, Ni and/or Mo, Mn, Mg and S, wherein the alloy is composed in per cent by weight of: C<2.9%, Si 3.8 to 4.3%, Cu 0.5 to 1.0%, Ni and/or Mo 0 to 4%, the molybdenum content being at most 1.0%, Mn 0.1 to 0.8%, Mg 0.03 to 0.07% and S at most 0.015%, wherein the C and Si are present in a substantially eutectic phase composition wherein the alloy, in the as cast condition, has a pearlite content of between 50 to 70% and a graphite content of at most 10%.

2. The nodular cast iron alloy as claimed in claim 1, wherein the C content is 2.6 to 2.9%.

3. The nodular cast iron alloy as claimed in claim 2, wherein the Si content is 3.8 to 4.0%.

4. The nodular cast iron alloy as claimed in claim 3, wherein the S content is less than 0.01%.

5. The nodular cast iron alloy as claimed in claim 4, wherein the modulus of elasticity is at least 170 GPa.

6. A crankshaft for motor vehicles produced from the nodular cast iron alloy as claimed in claim 5.

* * * * *